US006126412A

United States Patent [19]

Smith, III

[11] Patent Number: 6,126,412

[45] Date of Patent: Oct. 3, 2000

[54] FLUID DRIVEN PISTON ASSEMBLY AND FUEL INJECTOR USING SAME

[75] Inventor: Ralph A. Smith, III, Bloomington, Ill.

[73] Assignee: Caterpillar Inc., Peoria, Ill.

[21] Appl. No.: 08/987,950

[22] Filed: Dec. 10, 1997

[51] Int. Cl.[7] ..... F04B 17/04

[52] U.S. Cl. ..... 417/401; 123/446

[58] Field of Search ..... 417/401, 399; 123/446; 92/6 R

[56] References Cited

U.S. PATENT DOCUMENTS

| | | | |
|---|---|---|---|
| 2,537,748 | 1/1951 | Evans et al. | 417/401 |
| 3,329,068 | 7/1967 | Klaus | 91/402 |
| 3,689,205 | 9/1972 | Links | 417/401 |
| 3,771,917 | 11/1973 | Davies | 417/289 |
| 3,855,797 | 12/1974 | Papiau | 60/547 |
| 4,030,299 | 6/1977 | Reuschel et al. | 60/560 |
| 4,140,351 | 2/1979 | Nogami | 303/23 R |
| 5,107,681 | 4/1992 | Wolfbauer, III | 60/547.1 |
| 5,127,381 | 7/1992 | Kupzik et al. | 123/467 |
| 5,257,606 | 11/1993 | Willman et al. | 123/447 |

FOREIGN PATENT DOCUMENTS 2 297 359 7/1996 United Kingdom .

*Primary Examiner*—Timothy S. Thorpe
*Assistant Examiner*—Timothy P Solak
*Attorney, Agent, or Firm*—Michael McNeil

[57] ABSTRACT

A fluid driven piston assembly, preferably for use in a hydraulically-actuated fuel injector, includes a body that defines an actuation fluid cavity and a piston bore. A piston is positioned in the piston bore and moveable between a retracted position and an advanced position. The piston has a pressure surface exposed to fluid pressure in the actuation fluid cavity when it is away from its retracted position. A sealing member is positioned in sealing contact between the piston and the body when the piston is in its retracted position. The sealing member isolates a portion of the piston's pressure surface from the fluid pressure in the actuation fluid cavity when the piston is in its retracted position.

20 Claims, 3 Drawing Sheets

PISTON TOP PRESSURE
BASELINE (PRIOR ART)
INVENTION
MPa
0
TIME

PISTON POSITION
BASELINE (PRIOR ART)
INVENTION
mm
0
TIME

FUEL PRESSURE
BASELINE (PRIOR ART)
INVENTION
MPa
0
TIME

FLUID DRIVEN PISTON ASSEMBLY AND FUEL INJECTOR USING SAME

TECHNICAL FIELD

The present invention relates generally to fluid driven pistons, and more particularly to an improvement that increases the initial acceleration of a fluid driven piston in a fuel injector.

BACKGROUND ART

Hydraulically-actuated fuel injectors utilize a fluid driven piston to pressurize fuel within the injector body. The piston has a pressure surface exposed to fluid pressure in an actuation fluid cavity. An injection event is initiated by switching the actuation fluid cavity from connection to a low pressure drain to a high pressure inlet. The piston is normally biased toward a retracted position by a spring, but begins to move downward when the fluid pressure force overcomes the spring.

Downward movement of the piston intensifies the downward force on a plunger that pressurizes fuel in a fuel pressurization chamber. A biasing spring acting on a needle valve member normally holds the nozzle outlet of the fuel injector in a closed position, but the needle valve member lifts to open the nozzle outlet when the fuel pressure exceeds a predetermined valve opening pressure. Generally, it is desirable that the fuel pressure go from its minimum to its maximum pressure as quickly as possible so that the fuel pressure is as high as possible when the needle valve member in opening. Higher fuel pressures typically result in better atomization of the fuel entering the combustion space. This in turn typically results in more efficient combustion, which tends to result in improved emissions from the engine.

It has been observed that the quality of the initial portion of the injection can be improved if the initial acceleration of the piston can be increased. In other words, if the time taken for the piston to go from zero to its maximum speed is decreased, the speed at which the plunger moves will be increased, and hence the fuel pressure will rise much more rapidly. This problem is complicated by the fact that some finite amount of time is required for the actuation fluid cavity to rise in pressure from that of the low pressure drain up to that of the high pressure inlet.

The present invention is directed to overcoming these and other problems, as well as generally improving the performance of hydraulically-actuated fuel injectors.

DISCLOSURE OF THE INVENTION

In one embodiment, a fluid driven piston assembly includes a body that defines an actuation fluid cavity and a piston bore. A piston is positioned in the piston bore and moveable between a retracted position and an advanced position. The piston has a pressure surface exposed to fluid pressure in the actuation fluid cavity when the piston is away from its retracted position. A sealing member is positioned in sealing contact between the piston and the body when the piston is in its retracted position. The sealing member isolates a portion of the pressure surface from the fluid pressure in the actuation fluid cavity when the piston is at its retracted position.

In another embodiment, a fluid driven piston assembly includes a body that defines an actuation fluid cavity, a high pressure inlet, a low pressure drain, and a piston bore. An electronically controlled valve is attached to the body and has a first position in which the actuation fluid cavity is open to the high pressure inlet, and a second position in which the actuation fluid cavity is open to the low pressure drain. A piston is positioned in the piston bore and moveable between a retracted position and an advanced position. The piston has a pressure surface exposed to fluid pressure in the actuation fluid cavity when the piston is away from its retracted position. A biasing mechanism is operably positioned to bias the piston toward its retracted position. A sealing member is positioned in sealing contact between the piston and the body when the piston is in its retracted position. The sealing member isolates a portion of the pressure surface from fluid pressure in the actuation fluid cavity when the piston is in its retracted position.

In still another embodiment, a fuel injector includes an injector body that defines an actuation fluid cavity, a piston bore and a nozzle outlet. A piston is positioned in the piston bore and moveable between a retracted position and an advanced position. The piston has a pressure surface exposed to fluid pressure in the actuation fluid cavity when the piston is away from its retracted position. A sealing member is positioned in sealing contact between the piston and the injector body when the piston is in its retracted position. The sealing member isolates a portion of the pressure surface from fluid pressure in the actuation fluid cavity when the piston is in its retracted position.

BEST MODE FOR CARRYING OUT THE INVENTION

Figure 1:
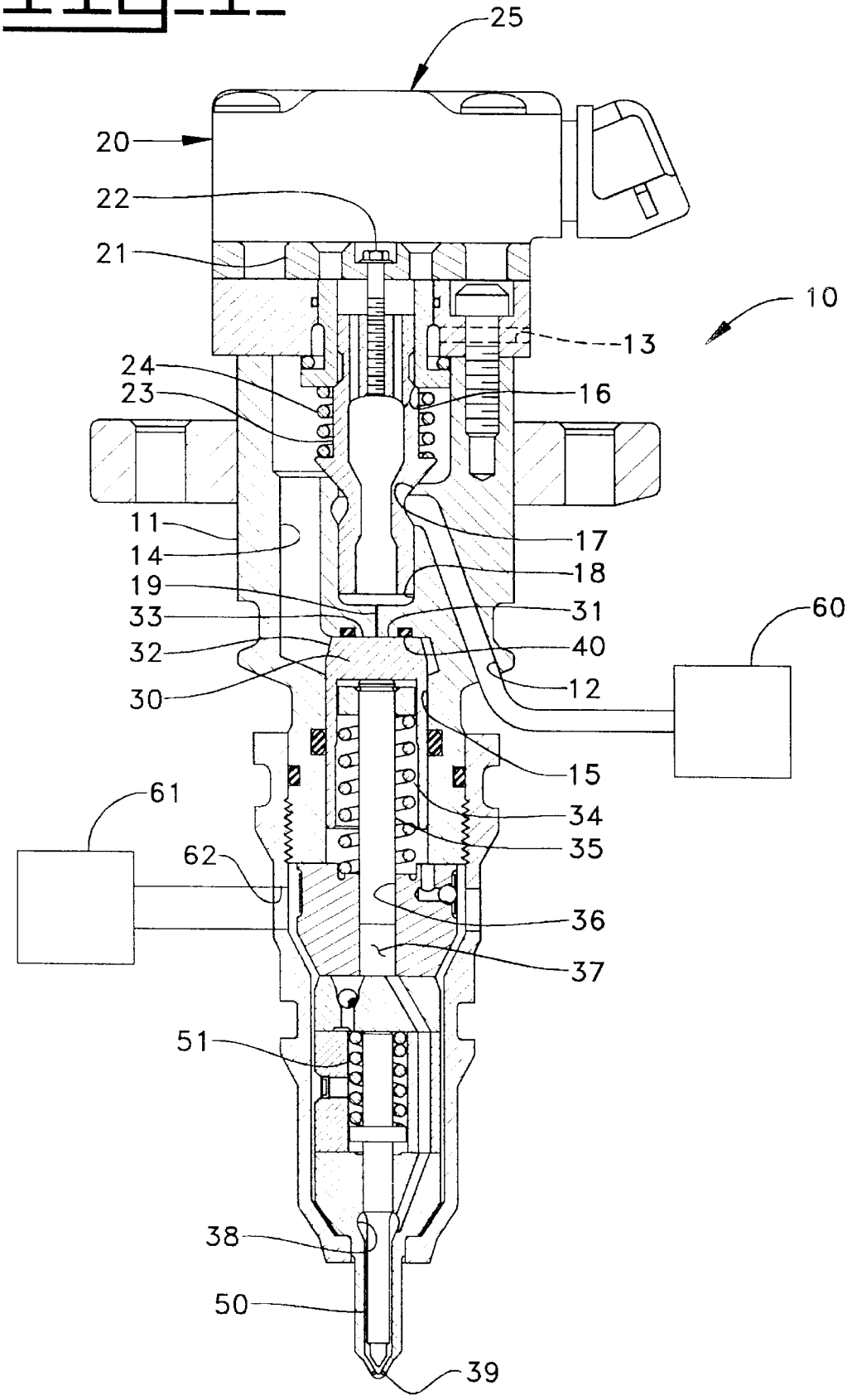
FIG. 1 is a sectioned side elevational view of a fuel injector according to the present invention.

Referring now to FIG. 1, a fuel injector 10 includes an injector body 11 that defines a high pressure actuation fluid inlet 12, a low pressure actuation fluid drain 13 and an actuation fluid cavity 14. Actuation fluid cavity 14 is separated from inlet 12 by a high pressure seat 17, and separated from drain 13 by a low pressure seat 16. Actuation fluid cavity 14 opens into a piston bore 15, within which is positioned an intensifier piston 30. High pressure inlet 12 is connected to a source of actuation fluid 60. A fuel inlet 62 is connected to a source of fuel 61 that is different from the actuation fluid.

An electronically controlled valve 25 includes a solenoid 20 with an armature 21 attached to a poppet valve member 23 with a fastener 22. Poppet valve member 23 moves in poppet bore 18 between low pressure seat 16 and high pressure seat 17. Poppet biasing spring 24 normally biases poppet valve member downward to close high pressure seat 17 and open low pressure seat 16. When solenoid 20 is energized, poppet valve member 23 is lifted against the action of spring 24 to close low pressure seat 16 and open high pressure seat 17. Thus, actuation fluid cavity 14 is normally open to the low pressure in actuation fluid drain 13, but is open to the high pressure of actuation fluid inlet 12 upon energizing solenoid 20. The lower portion of poppet bore 18 and the interior of poppet valve member 23 are always exposed to the low pressure of actuation fluid drain 13.

Figure 2:
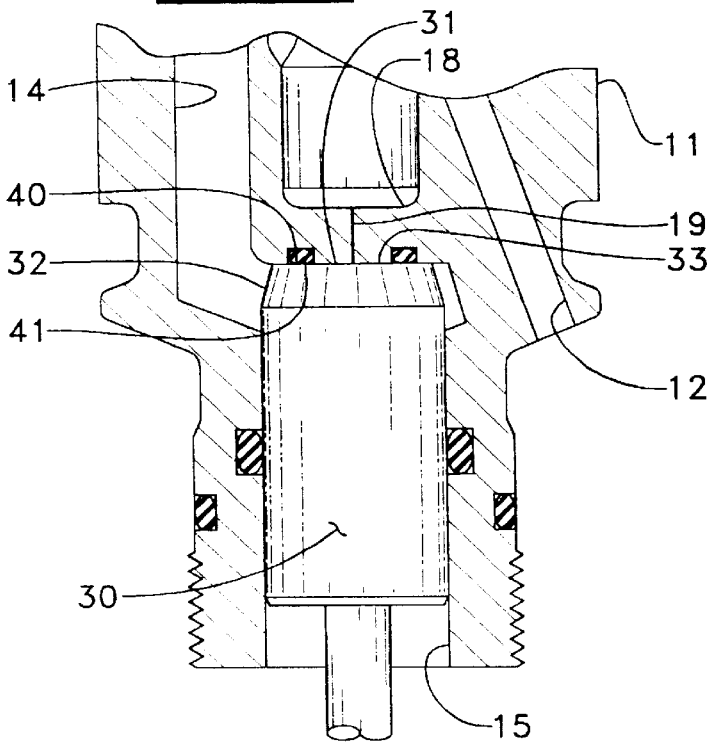
FIG. 2 is an enlarged view of the fluid driven piston assembly portion of the fuel injector shown in FIG. 1.

Piston 30 is moveable in piston bore between a retracted position, as shown, and an advanced position. Plunger 35 moves up and down with piston 30 in plunger bore 36. Piston 30 and plunger 36 are biased toward their retracted positions by a piston return spring 34. When piston 30 is away from its retracted position, its upper pressure surface 31 is exposed to the fluid pressure in actuation fluid cavity 14. When piston 30 is in its retracted position, only an outer portion 32 is exposed to the fluid pressure in cavity 14. A sealing member 40 isolates an inner portion 33 of pressure surface 31 when piston 30 is in its retracted position. Sealing member 40 is preferably a conventional O-ring 40 mounted in an annular groove 41 (FIG. 2) machined inside of injector body 11. A pin hole 19 extending between poppet bore 18 and actuation fluid cavity 14 allows a small amount of fluid to escape from above isolated portion 33 so that O-ring 40 can come into sealing contact between piston 30 and injector body 11 when the piston is in its retracted position.

A portion of plunger bore 36 and plunger 35 define a fuel pressurization chamber 37 that is in fluid communication with a nozzle chamber 38. A needle valve member 50 is positioned in injector body 11 and moveable between a closed position in which nozzle chamber 38 is blocked to nozzle outlet 39, and an upward open position in which nozzle chamber 38 is open to nozzle outlet 39. Needle valve member 50 is normally biased toward its closed position by a needle biasing spring 51. Needle valve member 50 is lifted to its open position against the action of spring 51 when fuel pressure in fuel pressurization chamber 37 and nozzle chamber 38 is above a valve opening pressure.

Figure 3:
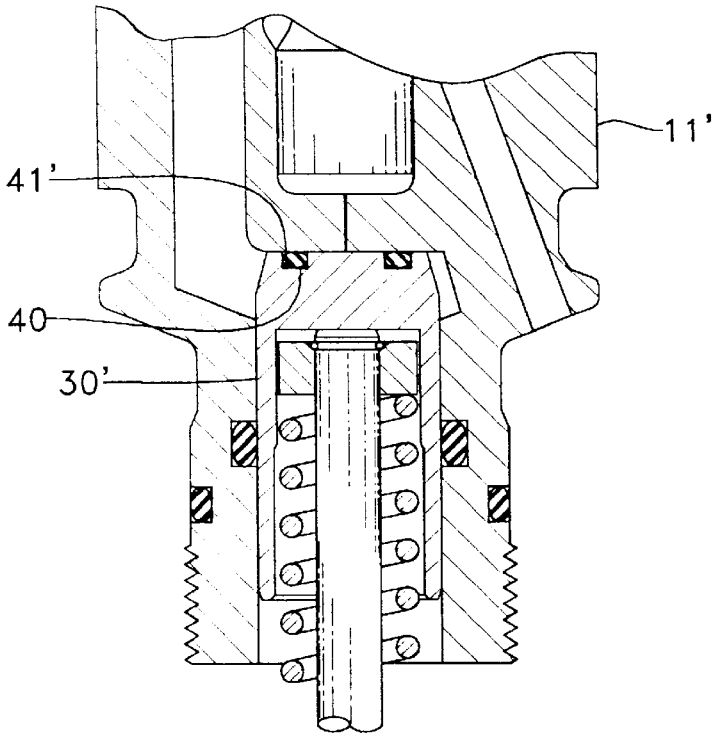
FIG. 3 is a fluid driven piston assembly according to another embodiment of the present invention.

Referring now to FIG. 3, an alternative embodiment of the present invention is illustrated in which O-ring 40 is mounted in an annular groove 41' machined in the top side of piston 30', instead of in the injector body as in the previous embodiment. In all other aspects, the embodiment shown in FIG. 3 is identical to that shown in FIGS. 1 and 2.

Industrial Applicability

Figure 4A:
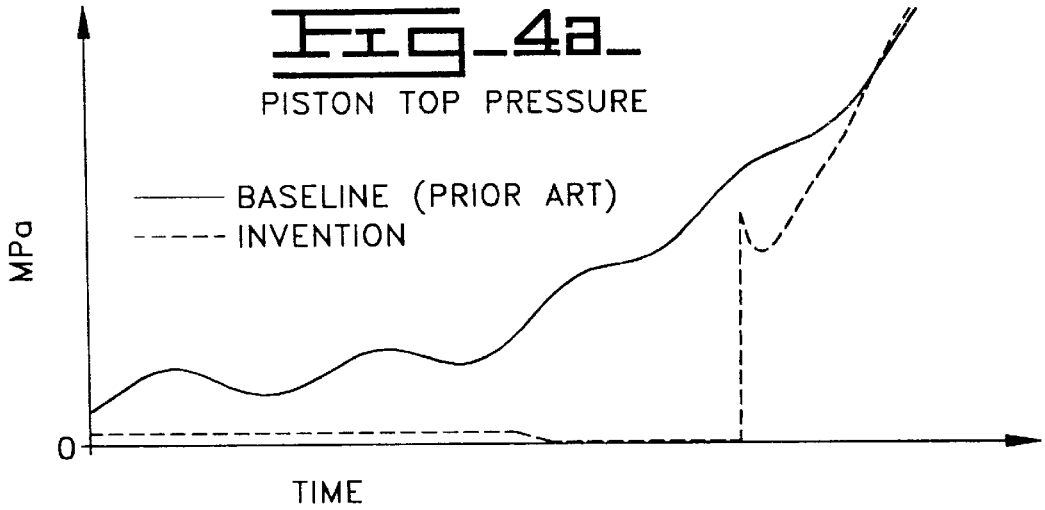
FIGS. 4*a–c* are graphs of piston top pressure, piston position and fuel pressure, respectively, versus time for the beginning portion of a fuel injection event for a fuel injector with and without the present invention.
Figure 4B:
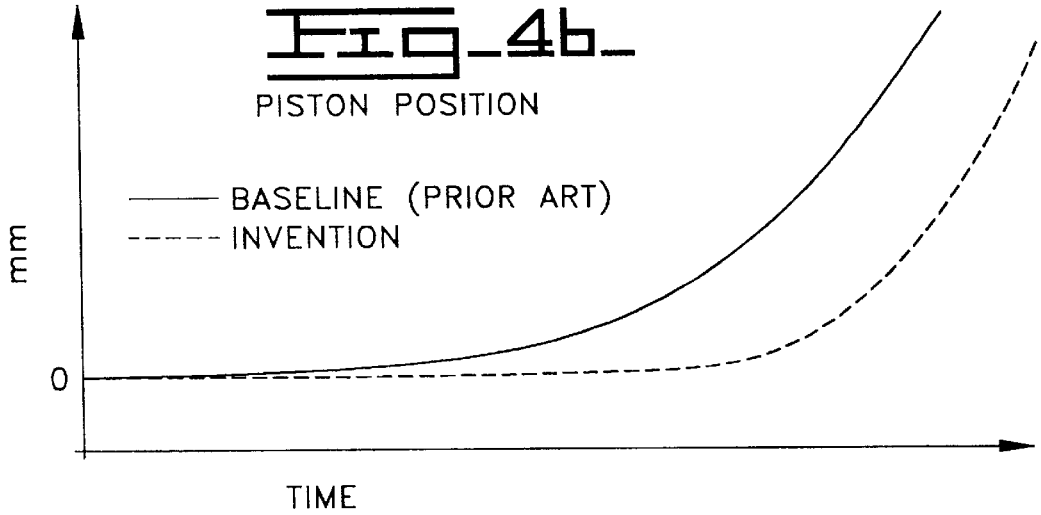
Figure 4C:
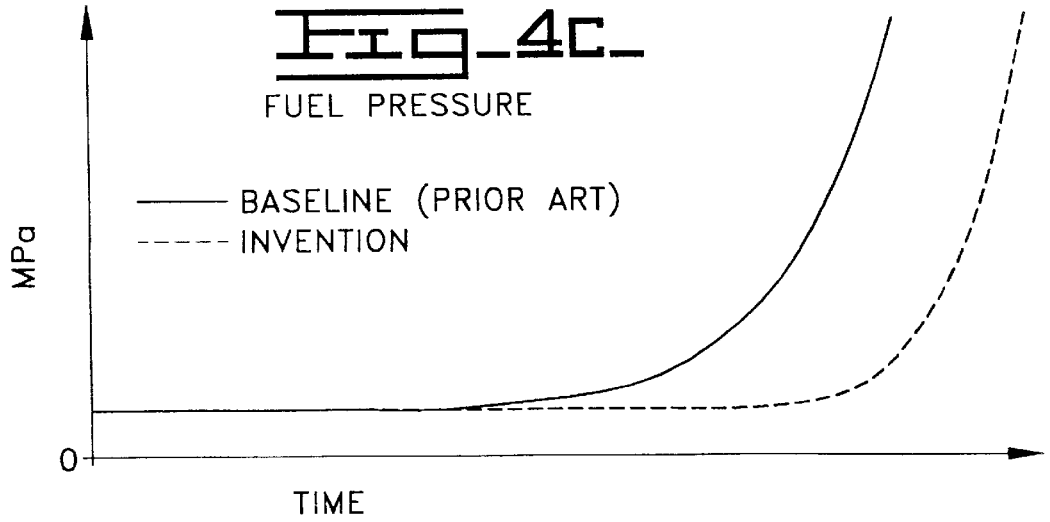

Referring now in addition to FIGS. 4*a–c,* each injection event begins by energizing solenoid 20 to lift poppet valve member 23 against the action of biasing spring 24. The upward movement of poppet valve member 23 opens high pressure seat 17 and closes low pressure seat 16. As this occurs, fluid pressure in actuation fluid cavity 14 begins to rise. Eventually the pressure acting on piston 30 will be sufficiently high that it will begin to move downward against the action of its return spring 34. It is during the beginning movement portion of the piston that the effect of the sealing member 40 of the present invention reveals itself in the performance of the fuel injector.

In prior art fuel injectors, the complete top of the piston is exposed to fluid pressure in cavity 14 when in its retracted position. However, in the present invention, only a relatively small outer portion 32 of piston 30 is exposed to fluid pressure in cavity 14 when the piston is in its retracted position. The isolated portion 33 of pressure surface 31 preferably accounts for a majority of the total pressure surface, and preferably accounts for in excess of 90% of the total area of pressure surface 31. Those skilled in the art will appreciate that if the isolated portion 33 accounted for 100% of the pressure surface 31, the piston would not move regardless of the pressure in cavity 14. On the other hand, if the isolated portion 33 were relatively small portion of pressure surface 31, the present invention would have only a negligible effect on the initial movement of piston 30.

Because only a relatively small portion of pressure surface 31 is exposed to fluid pressure in cavity 14 when the piston is in its retracted position, the fluid pressure must be significantly higher before the pressure force is sufficient to begin movement of the piston against the action of return spring 34. In prior art injectors of this type, the piston would begin its movement well before the fluid pressure in cavity 14 reached its peak pressure. It is important to note that the comparison shown in FIGS. 4*a–c* assumes that the prior art and present injector are alike in virtually all respects, are commanded to inject an identical volume of fluid, and the solenoid is energized at an identical initial time. Those skilled in the art will appreciate that if the present invention were incorporated into an engine, some minor adjustments in the software that controls the operation of the fuel injector would have to be employed in order to account for the slight time delay in beginning of the injection event that is created by the sealing member of the present invention. This delay is revealed in the plot of fuel pressure versus time.

In the present invention, the pressure in cavity 14 is significantly higher before piston 30 begins its downward movement. Preferably, the relative sizing of exposed portion 32 to that of isolated portion 33 of pressure surface 31 are sized such that piston 30 does not begin to move until fluid pressure in cavity 14 is near its peak pressure. Thus, after piston 30 moves a slight distance downward, the seal created by O-ring 40 is broken, and suddenly the complete pressure surface 31 is exposed to the high pressure in cavity 14. This causes piston 30 to quickly accelerate downward. This in turn causes plunger 35 to accelerate downward, and results in a significantly quicker rise in fuel pressure within fuel pressurization chamber 37 than that observed in prior art fuel injectors of this type.

Preferably, the seal created by O-ring 40 is broken before the fuel pressure exceeds its valve opening pressure. Thus, the fuel pressure is in the process of rising much more rapidly than that of the prior art before needle valve member 50 lifts to its open position. Because of the dynamics involved from the accelerated action of piston 30, the fuel pressure in fuel pressurization chamber 37 is able to achieve a significantly higher peak pressure than an otherwise identical fuel injector of the prior art. This results in the ability to shorten the injection event while injecting an identical amount of fuel.

The present invention serves to improve the combustion efficiency in several respects. First, better atomization occurs at the very beginning of the injection event since the fuel pressure is higher when the needle valve member moves to its open position. Second, peak injection pressures are higher, which also results in better fuel atomization during the main portion of each injection event. Finally, the higher peak fuel pressures reduce the duration of the injection event, which itself is believed to aid in improving the efficiency of the combustion event. All these three factors serve to improve the efficiency of the combustion event, which results in improved emissions from the engine.

The above description is intended for illustrative purposes only, and is not intended to limit the scope of the present invention in any way. For instance, the concepts of the present invention can be applied in virtually any fluid driven piston assembly where it is desired to increase the initial acceleration of the piston from its retracted position, for whatever reason makes that desirable in a given application. Thus, those skilled in the art will appreciate that various modifications can be made to the illustrated embodiment of the present invention, and the teachings of the present invention can be utilized in various applications without departing from the spirit and scope of the invention, which is defined in terms of the claims as set forth below.

What is claimed is:

1. A fluid driven piston assembly comprising;

a body defining an actuation fluid cavity and a piston bore;

a piston positioned in said piston bore and being movable between a retracted position and an advanced position, and said piston having a pressure surface exposed to fluid pressure in said actuation fluid cavity when said piston is away from said retracted position; and a sealing member in sealing contact between said piston and said body when said piston is in said retracted position, and said sealing member isolating an inner portion of said pressure surface from fluid pressure in said actuation fluid cavity when said piston is in said retracted position.

2. The fluid driven piston assembly of claim 1 wherein said inner portion is a majority of said pressure surface.

3. The fluid driven piston assembly of claim 2 wherein said majority is in excess of 90% of said pressure surface.

4. The fluid driven piston assembly of claim 1 wherein said sealing member is an O-ring.

5. The fluid driven piston assembly of claim 4 wherein said O-ring is mounted on said body.

6. The fluid driven piston assembly of claim 1 further comprising a source of high pressure actuation fluid and a low pressure drain;

said actuation fluid cavity being connected to said source of high pressure fluid when said piston is moving toward said advanced position; and said actuation fluid cavity being connected to said low pressure drain when said piston is moving toward said retracted position.

7. The fluid driven piston assembly of claim 6 wherein said sealing member is an O-ring mounted on said body; and said inner portion is substantially more than a majority of said pressure surface.

8. A fluid driven piston assembly comprising;

a body defining an actuation fluid cavity, a high pressure inlet, a low pressure drain and a piston bore;

an electronically controlled valve attached to said body and having a first position in which said actuation fluid cavity is open to said high pressure inlet and a second position in which said actuation fluid cavity is open to said low pressure drain;

a piston positioned in said piston bore and being movable between a retracted position and an advanced position, and said piston having a pressure surface exposed to fluid pressure in said actuation fluid cavity when said piston is away from said retracted position;

a biasing mechanism operably positioned to bias said piston toward said retracted position; and a sealing member in sealing contact between said piston and said body when said piston is in said retracted position, and said sealing member isolating an inner portion of said pressure surface from fluid pressure in said actuation fluid cavity when said piston is in said retracted position.

9. The fluid driven piston assembly of claim 8 wherein said inner portion is a majority of said pressure surface.

10. The fluid driven piston assembly of claim 9 wherein said majority is in excess of 90% of said pressure surface.

11. The fluid driven piston assembly of claim 8 wherein said sealing member is an O-ring.

12. The fluid driven piston assembly of claim 11 wherein said O-ring is mounted on said body.

13. The fluid driven piston assembly of claim 8 wherein said sealing member is an O-ring mounted on said body; and said inner portion is substantially more than a majority of said pressure surface.

14. A fuel injector comprising:

an injector body defining an actuation fluid cavity, a piston bore and a nozzle outlet;

a piston positioned in said piston bore and being movable between a retracted position and an advanced position, and said piston having a pressure surface exposed to fluid pressure in said actuation fluid cavity when said piston is away from said retracted position; and a sealing member in sealing contact between said piston and said injector body when said piston is in said retracted position, and said sealing member isolating an inner portion of said pressure surface from fluid pressure in said actuation fluid cavity when said piston is in said retracted position.

15. The fuel injector of claim 14 further comprising a source of actuation fluid and a source of fuel fluid that is different from said actuation fluid;

said injector body defines an actuation fluid inlet connected to said source of actuation fluid and a fuel inlet connected to said source of fuel fluid.

16. The fuel injector of claim 14 wherein said inner portion is a majority of said pressure surface.

17. The fuel injector of claim 16 wherein said majority is in excess of 90% of said pressure surface.

18. The fuel injector of claim 14 wherein said sealing member is an O-ring.

19. The fuel injector of claim 18 wherein said O-ring is mounted on said injector body.

20. The fuel injector of claim 15 wherein said sealing member is an O-ring mounted on said injector body; and said inner portion is substantially more than a majority of said pressure surface.

* * * * *